US006763680B2

(12) United States Patent
Fischer et al.

(10) Patent No.: US 6,763,680 B2
(45) Date of Patent: Jul. 20, 2004

(54) LIQUEFACTION OF NATURAL GAS WITH NATURAL GAS RECYCLING

(75) Inventors: Béatrice Fischer, Lyons (FR); Pierre-Yves Martin, Rueil Malmaison (FR); Alexandre Rojey, Rueil Malmaison (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 10/465,597

(22) Filed: Jun. 20, 2003

(65) Prior Publication Data

US 2004/0003625 A1 Jan. 8, 2004

(30) Foreign Application Priority Data

Jun. 21, 2002 (FR) ..... 02 07692

(51) Int. Cl.[7] ..... F25J 1/00
(52) U.S. Cl. ..... 62/612; 62/613
(58) Field of Search ..... 62/606, 611, 612, 62/613

(56) References Cited

U.S. PATENT DOCUMENTS 3,690,114 A 9/1972 Swearingen et al. ..... 62/40
4,225,329 A 9/1980 Bailey ..... 62/24
4,541,852 A 9/1985 Newton et al. ..... 62/11
6,070,429 A 6/2000 Low et al. ..... 62/612
6,449,982 B1 * 9/2002 Fischer ..... 62/613

FOREIGN PATENT DOCUMENTS

EP 1 118 827 A1 7/2001 ..... F25J/1/02

OTHER PUBLICATIONS

Preliminary Search Report.

* cited by examiner

*Primary Examiner*—Denise L. Esquivel
*Assistant Examiner*—Malik N. Drake
(74) *Attorney, Agent, or Firm*—Antonelli, Terry, Stout & Kraus, LLP

(57) ABSTRACT

Natural gas liquefaction method wherein the natural gas is cooled, condensed and subcooled by indirect heat exchange with two cooling mixtures to a temperature such that the natural gas does not remain entirely liquid under pressure after expansion to the atmospheric pressure. The liquid natural gas under pressure is expanded to form a gas phase and a liquid phase. The gas phase can be either compressed and recycled to the process inlet, or used as a fuel. The liquid phase is expanded to form a gas phase and a liquid phase. The gas phase is compressed and recycled to the process inlet. The liquid phase constitutes the liquefied natural gas produced.

11 Claims, 4 Drawing Sheets

LIQUEFACTION OF NATURAL GAS WITH NATURAL GAS RECYCLING

FIELD OF THE INVENTION

The present invention relates to the field of natural gas liquefaction. Liquefaction of natural gas consists in condensing the natural gas and in subcooling it to a temperature that is low enough for the gas to remain liquid at the atmospheric pressure. It is then transported in LNG carriers.

The international liquid natural gas (LNG) trade is currently developing rapidly, but the whole of the LNG production chain requires considerable investment. Reduction of this investment is therefore a priority objective.

BACKGROUND OF THE INVENTION

Document U.S. Pat. No. 6,105,389 provides a liquefaction method comprising two cooling mixtures that circulate in two closed and independent circuits. Each circuit works by means of a compressor supplying the cooling mixture with the necessary power for cooling the natural gas. Each compressor is driven by a gas turbine selected from among the commercially available standard ranges. However, the power of the gas turbines currently available is limited.

The present invention is aimed to improve the method disclosed by document U.S. Pat. No. 6,105,389 in order to increase the liquefaction power while keeping the standard compressors.

SUMMARY OF THE INVENTION

One object of the present invention is to allow to reduce the investment cost required for a liquefaction plant. Another object of the present invention is to carry out, under better conditions, separation of the nitrogen that may be contained in the gas.

The principle of the method according to the invention consists in condensing and in subcooling the natural gas under pressure by indirect heat exchange with one or more cooling mixtures. However, subcooling is performed to a temperature such that the natural gas does not remain entirely liquid after expansion to the atmospheric pressure. In the method according to the invention, the liquefied natural gas under pressure is expanded in at least two stages so as to obtain at least two gas fractions. At least one gas fraction is recompressed and mixed with the natural gas prior to condensation.

The present invention provides a natural gas liquefaction method comprising the following stages:

a) combining the natural gas with a compressed gas obtained in stage f) to obtain a mixture of natural gas, b) cooling the natural gas mixture and a second cooling mixture by indirect heat exchange with at least a first cooling mixture so as to obtain a cooled natural gas and a cooled second cooling mixture, then condensing and cooling the cooled natural gas by indirect heat exchange with the cooled second cooling mixture and with a first gas fraction obtained in stage c) so as to obtain a liquefied natural gas under pressure, c) expanding the liquefied natural gas under pressure obtained in stage b) to obtain a liquid fraction and the first gas fraction, d) cooling the liquid fraction obtained in stage c) by indirect heat exchange with a second gas fraction obtained in stage e) so as to obtain a cooled liquid fraction and a heated second gas fraction, e) expanding the cooled liquid fraction obtained in stage d) to obtain a liquefied natural gas and the second gas fraction, f) compressing at least part of the heated second gas fraction obtained in stage d) to obtain the compressed gas.

The liquefied natural gas under pressure obtained in stage b) can be at a temperature that is higher by at least 10° C. than the bubble-point temperature of the liquefied natural gas obtained in stage e) at the atmospheric pressure.

The liquefied natural gas under pressure obtained in stage b) can be at a temperature ranging between −105° C. and −145° C., and at a pressure ranging between 4 MPa and 7 MPa.

In stage f), part of the first gas fraction obtained in stage c) and part of the heated second gas fraction obtained in stage d) can be compressed to obtain a compressed gas.

A denitrogenation treatment can be applied to the liquid fraction and to the first gas fraction obtained in stage c) to enrich the first gas fraction with nitrogen.

In stage b), the natural gas mixture can be condensed and cooled by indirect heat exchange with the first cooling mixture and a second cooling mixture, the second cooling mixture being condensed by indirect heat exchange with the first cooling mixture. In stage d), the liquid fraction obtained in stage c) can be cooled by heat exchange with the second gas fraction obtained in stage e) and with the second cooling mixture.

In stage a), the natural gas can be at a temperature ranging between 30° C. and 60° C., and at a pressure ranging between 4 MPa and 7 MPa.

The natural gas mixture and the second cooling mixture can be cooled to a temperature ranging between −35° C. and −70° C. by heat exchange with the first cooling mixture.

In stage c), said liquefied natural gas under pressure can be expanded to a pressure ranging between 0.2 MPa and 1 MPa and, in stage e), said liquid fraction can be expanded to a pressure ranging between 0.05 MPa and 0.5 MPa.

The first cooling mixture can comprise the following components in molar fraction:

| | |
|---|---|
| Ethane: | 30% to 70% |
| Propane: | 30% to 70% |
| Butane: | 0% to 20%. |

The second cooling mixture can comprise the following components in molar fraction:

| | |
|---|---|
| Nitrogen: | 0% to 10% |
| Methane: | 30% to 70% |
| Ethane: | 30% to 70% |
| Propane: | 0% to 10%. |

In fact, the method according to the invention allows to significantly increase the production capacity by adding a limited number of additional equipments.

The method according to the invention is particularly advantageous when each cooling circuit uses a cooling mixture that is entirely condensed, expanded and vaporized.

BRIEF DESCRIPTION OF THE FIGURES

Other features and advantages of the invention will be clear from reading the description hereafter, with reference to the accompanying drawings wherein.

DETAILED DESCRIPTION

Figure 1:
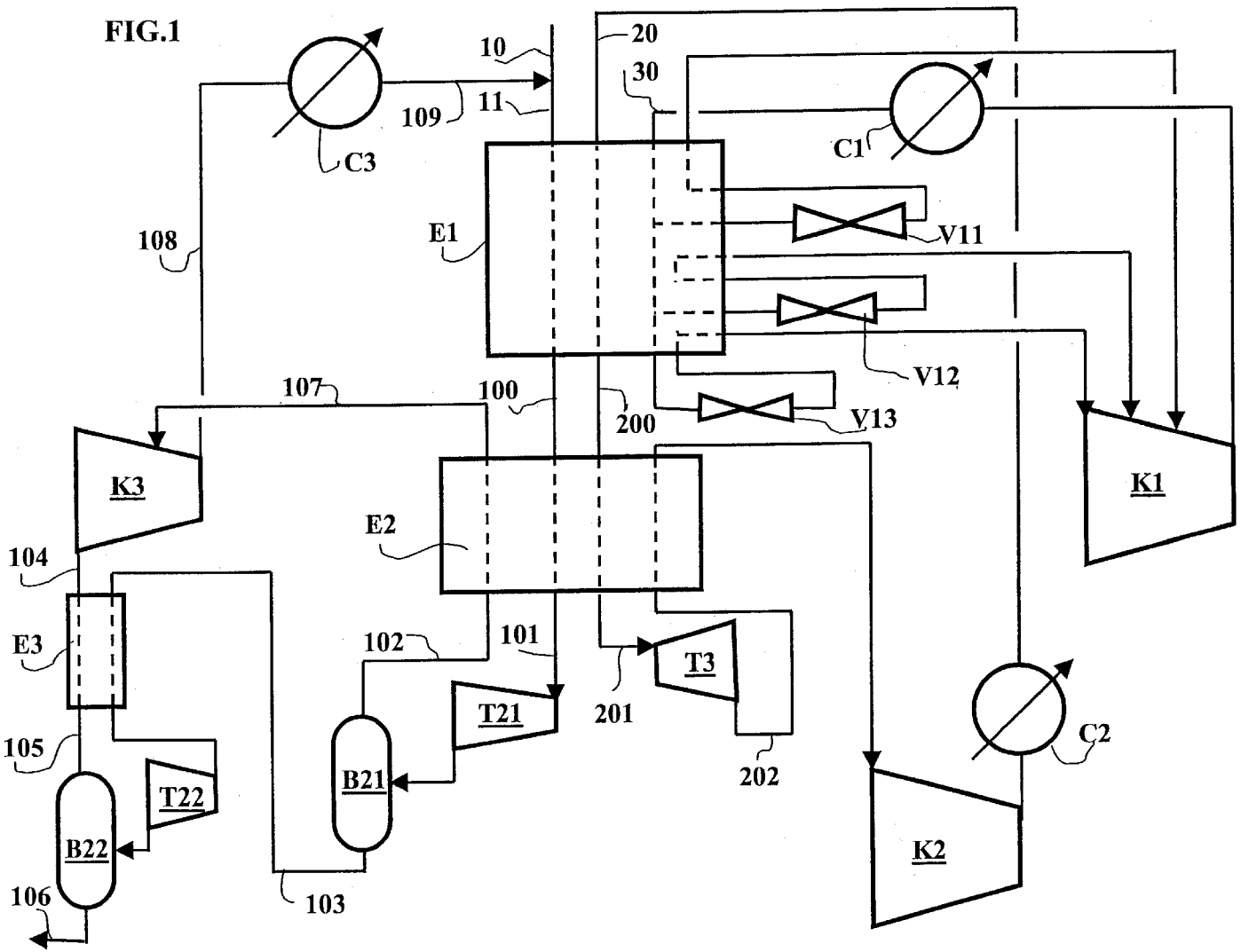
FIG. 1 diagrammatically shows a liquefaction method according to the invention, FIG. 2 diagrammatically shows the method of FIG. 1 comprising a denitrogenation stage, FIG. 3 diagrammatically shows a variant of the liquefaction method according to the invention, FIG. 4 diagrammatically shows the method of FIG. 3 comprising a denitrogenation stage.

According to the natural gas liquefaction method diagrammatically shown in FIG. 1, the natural gas flows in through line 10 for example at a pressure ranging between 4 MPa and 7 MPa and at a temperature ranging between 30° C. and 60° C. The natural gas circulating in line 10 is combined with the gas coming from line 109 to form a natural gas mixture that circulates in line 11. The gas circulating in line 11, the first cooling mixture circulating in line 30 and the second cooling mixture circulating in line 20 flow into exchanger E1 where they circulate in parallel and cocurrent directions.

The natural gas leaves exchanger E1 through line 100, for example at a temperature ranging between −35° C. and −70° C. The second cooling mixture leaves exchanger E1 totally condensed through line 200, for example at a temperature ranging between −35° C. and −70° C.

In exchanger E1, three fractions of the first cooling mixture in the liquid phase are successively discharged. The fractions are expanded through expansion valves V11, V12 and V13 to three different pressure levels, then vaporized in exchanger E1 by heat exchange with the natural gas, the second cooling mixture and part of the first cooling mixture. The three vaporized fractions are sent to various stages of compressor K1. The vaporized fractions are compressed in compressor K1, then condensed in condenser C1 by heat exchange with an outside cooling fluid, water or air for example. The first cooling mixture coming from condenser C1 is sent to exchanger E1 through line 30. The pressure of the first cooling mixture at the outlet of compressor K1 can range between 2 MPa and 6 MPa. The temperature of the first cooling mixture at the outlet of condenser C1 can range between 30° C. and 55° C.

The first cooling mixture can consist of a mixture of hydrocarbons such as a mixture of ethane and propane, but it can also contain methane, butane and/or pentane. The proportions in molar fraction (%) of the components of the first cooling mixture can be:

| | |
|---|---|
| Ethane: | 30% to 70% |
| Propane: | 30% to 70% |
| Butane: | 0% to 20%. |

The natural gas that circulates in line 100 can be fractionated, i.e. part of the $C_{2+}$ hydrocarbons containing at least two carbon atoms is separated from the natural gas by means of a device known to the man skilled in the art. The fractionated natural gas is sent through line 100 to exchanger E2. The $C_{2+}$ hydrocarbons collected are sent to fractionating columns comprising a deethanizer. The light fraction collected at the top of the deethanizer can be mixed with the natural gas circulating in line 100. The liquid fraction collected at the bottom of the deethanizer is sent to a depropanizer.

The gas circulating in line 100 and the second cooling mixture circulating in line 200 flow into exchanger E2 where they circulate in parallel and cocurrent directions.

The second cooling mixture flowing out of exchanger E2 through line 201 is expanded by expansion device T3. Expansion device T3 can be a turbine, a valve or a combination of a turbine and of a valve. The expanded second cooling mixture from turbine T3 is sent through line 202 into exchanger E2 to be vaporized by cooling the natural gas and the second cooling mixture in a countercurrent flow. At the outlet of exchanger E2, the vaporized second cooling mixture is compressed by compressor K2, then cooled in indirect heat exchanger C2 by heat exchange with an outside cooling fluid, water or air for example. The second cooling mixture from exchanger C2 is sent to exchanger E1 through line 20. The pressure of the second cooling mixture at the outlet of compressor K2 can range between 2 MPa and 6 MPa. The temperature of the second cooling mixture at the outlet of exchanger C2 can range between 30° C. and 55° C.

In the method described in connection with FIG. 1, the second cooling mixture is not divided into separate fractions but, in order to optimize the approach in exchanger E2, the second cooling mixture can also be separated into two or three fractions, each fraction being expanded to a different pressure level and sent to various stages of compressor K2.

The second cooling mixture consists for example of a mixture of hydrocarbons and nitrogen such as a mixture of methane, ethane and nitrogen, but it can also contain propane and/or butane. The proportions in molar fraction (%) of the components of the second cooling mixture can be:

| | |
|---|---|
| Nitrogen: | 0% to 10% |
| Methane: | 30% to 70% |
| Ethane: | 30% to 70% |
| Propane: | 0% to 10%. |

The natural gas leaves heat exchanger E2 in the liquefied state through line 101 at a temperature preferably higher by at least 10° C. than the bubble-point temperature of the liquefied natural gas produced at atmospheric pressure (the bubble-point temperature is the temperature at which the first vapor bubbles form in a liquid natural gas at a given pressure) and at the same pressure as the natural gas inlet pressure, apart from the pressure drops. For example, the natural gas leaves exchanger E2 at a temperature ranging between −105° C. and −145° C., and at a pressure ranging between 4 MPa and 7 MPa. Under these temperature and pressure conditions, the natural gas does not remain entirely liquid after expansion to the atmospheric pressure.

The natural gas from exchanger E2 is sent through line 101 to expansion device T21 to be expanded to a pressure ranging between 0.1 MPa and 1 MPa. The two-phase mixture obtained at the outlet of the expansion device is separated in separation drum B21 in form of a gas fraction and a liquid fraction. The gas fraction discharged from drum B21 through line 102 is fed into exchanger E2. In exchanger E2, the gas fraction cools the natural gas in a countercurrent flow, then it is sent through line 107 to compressor K3. The liquid fraction discharged from drum B21 through line 103 is cooled in exchanger E3 and expanded in expansion device T22 to a pressure ranging between 0.05 MPa and 0.5 MPa. Expansion devices T21 and T22 can be an expansion turbine, an expansion valve or a combination of a turbine and of a valve. The two-phase mixture obtained at the outlet of expansion device T22 is separated in separation drum B22 in form of a gas fraction and a liquid fraction. The gas fraction discharged from drum B22 through line 105 is fed into exchanger E3. In exchanger E3, the gas fraction cools the liquid fraction obtained in drum B21 and it is sent through line 104 to compressor K3. The gas mixture leaving compressor K3 through line 108 is sent to heat exchanger C3 to be cooled by air or water. The gas mixture leaving exchanger C3 through line 109 is combined with the natural gas circulating in line 10.

The liquid fraction discharged from drum B22 through line 106 forms the LNG produced.

When the natural gas flowing through line 10 contains an excess amount of nitrogen in relation to the specifications required for the LNG produced, the method according to the invention further comprises a denitrogenation stage. Such a method is diagrammatically shown in FIG. 2.

Figure 2:
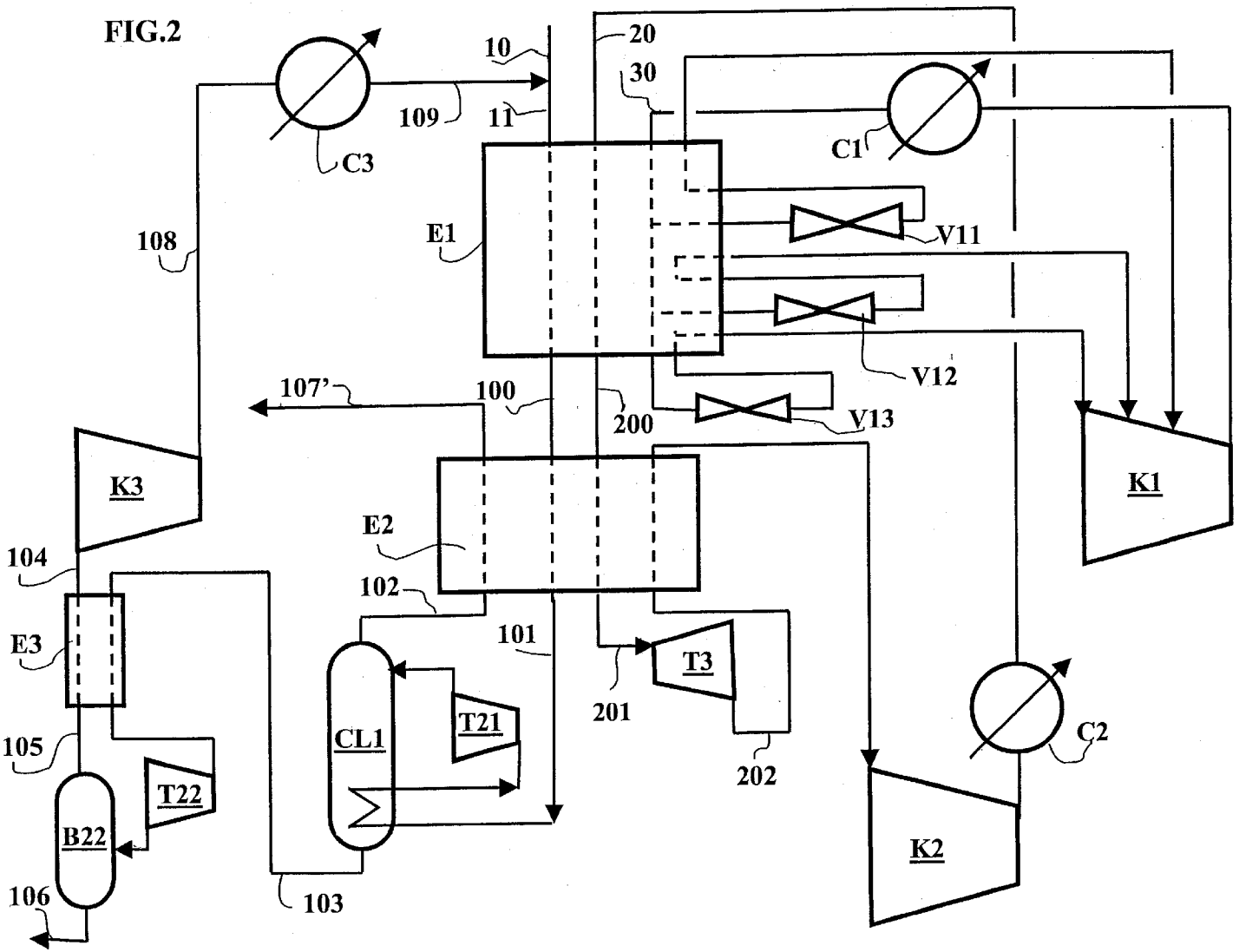
Figure 3:
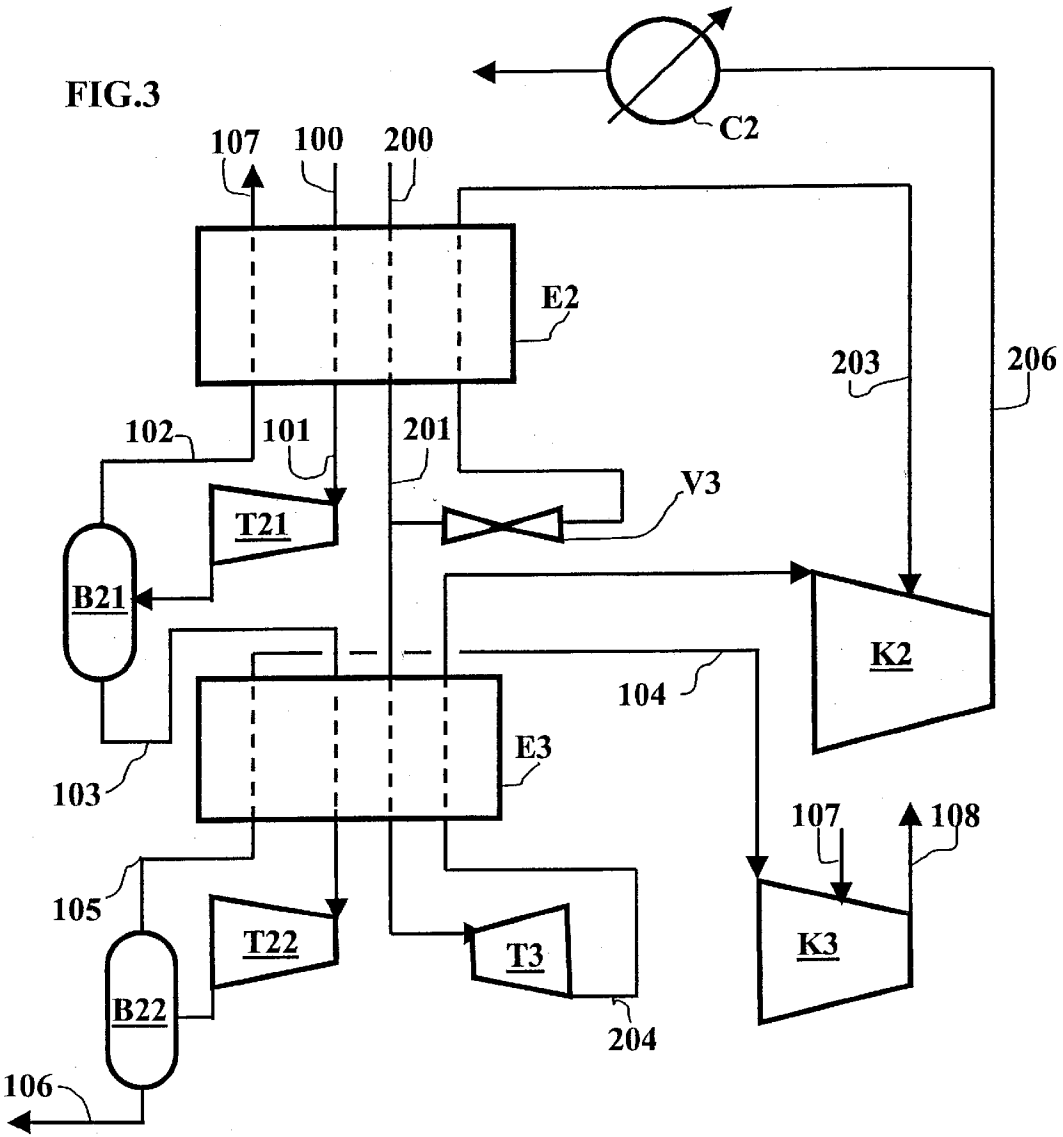
Figure 4:
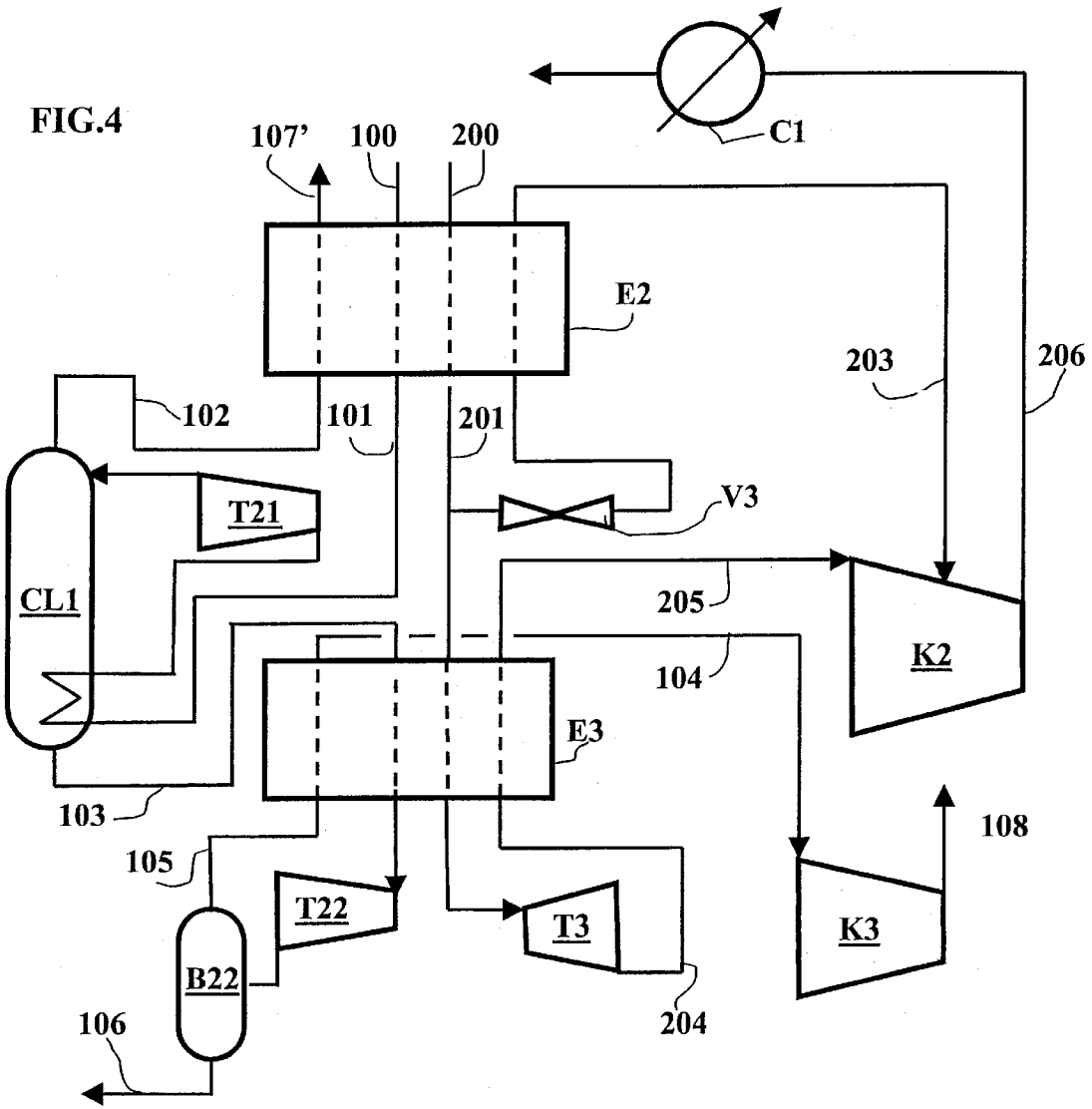

The reference numbers in FIGS. 2, 3 and 4 identical to the reference numbers of FIG. 1 designate identical elements.

The method diagramatically shown in FIG. 2 is substantially identical to the method shown in FIG. 1, except for drum B21 which is replaced by denitrogenation column CL1 and line 107 which is replaced by line 107'. The natural gas circulating in line 101 is sent to denitrogenation column CL1. The natural gas is cooled by heating the bottom of column CL1 by indirect heat exchange, then it is expanded in expansion device T21. The two-phase mixture obtained at the outlet of device T21 is sent to the top of column CL1. At the top of column CL1, a nitrogen-enriched gas fraction is collected. It is sent to exchanger E2 as a cooling agent, then it is discharged through line 107'. The gas circulating in line 107' can be used as fuel gas, a source of energy for the liquefaction plant. At the bottom of column CL1, a nitrogen-depleted liquid fraction is collected and sent to exchanger E3 through line 103.

The method diagrammatically shown in FIG. 3 is a variant of the method shown in FIG. 1 wherein exchanger E3 is also cooled by the second cooling mixture. The layout of exchanger E1 and the circuit in which the first cooling mixture circulates are identical to those of FIG. 1 and are not shown in FIG. 3.

The natural gas leaving heat exchanger E1 through line 100 is subjected, in exchanger E1, to the same treatment as the treatment previously described in connection with FIG. 1. The natural gas flowing in through line 100 is liquefied and subcooled in heat exchanger E2. The natural gas from exchanger E2 is fed into expansion device T21 through line 101. The two-phase mixture obtained at the outlet of device T21 is separated in drum B21 into a liquid fraction and a gas fraction. The gas fraction discharged from drum B21 through line 102 is fed into exchanger E2. In exchanger E2, the gas fraction cools the natural gas and the second cooling mixture in a countercurrent flow, and it is sent through line 107 to compressor K3. The liquid fraction discharged from drum B21 through line 103 is cooled in exchanger E3, then expanded by expansion device T22. The two-phase mixture obtained at the outlet of device T22 is separated in drum B22 into a gas fraction and a liquid fraction. The gas fraction discharged from drum B22 through line 105 is fed into exchanger E3. In exchanger E3, the gas fraction cools the liquid fraction coming from drum B21 through line 103 and a fraction of the second cooling mixture in a countercurrent flow, then it is sent through line 104 to compressor K3. The mixture leaving compressor K3 through line 108 in the compressed vapor phase is recycled to the inlet of exchanger E1, after cooling in exchanger C3. The liquid fraction discharged from drum B22 through line 106 constitutes the LNG produced.

The second cooling mixture leaving exchanger E1 in the condensed state is fed into heat exchanger E2 through line 200. At the outlet of exchanger E2, the cooling mixture circulating in line 201 is separated into two fractions. A first fraction is expanded by expansion valve V3 (for example between 0.3 MPa and 1 MPa), then it is fed into exchanger E2 to cool the natural gas and the second cooling mixture in a countercurrent flow. At the outlet of exchanger E2, the first vaporized fraction is fed into compressor K2 through line 203. The second fraction is fed into and cooled in exchanger E3, then it is expanded by expansion device T3, for example between 0.1 and 0.3 MPa. The expanded second fraction is fed through line 204 into heat exchanger E3 to cool the natural gas and the second fraction in a countercurrent flow. At the outlet of exchanger E3, the vaporized second fraction is fed into compressor K2 to be compressed between 3 MPa and 7 MPa. The mixture leaving compressor K3 through line 206 in the compressed vapor phase is recycled to the inlet of exchanger E1 after cooling in exchanger C3.

When the natural gas to be treated contains an excess amount of nitrogen in relation to the specifications required for the LNG produced, the method shown in FIG. 3 further comprises a denitrogenation stage.

The method diagrammatically shown in FIG. 4 is substantially identical to the method shown in FIG. 3, except for drum B21 which is replaced by denitrogenation column CL1 and line 107 which is replaced by line 107'. The natural gas circulating in line 101 is sent to denitrogenation column CL1. The natural gas is cooled by heating the bottom of column CL1 by indirect heat exchange, then it is expanded in expansion device T21. The two-phase mixture obtained at the outlet of expansion device T21 is sent to the top of column CL1. At the top of column CL1, a nitrogen-enriched gas fraction is collected. It is sent to exchanger E2 from which it is discharged through line 107'. The gas circulating in line 107' can be used as fuel gas, a source of energy for the liquefaction plant. At the bottom of column CL1, a nitrogen-depleted liquid fraction is collected and sent to exchanger E3 through line 103.

The method described in connection with FIG. 1 is illustrated by the numerical example as follows.

The natural gas flows in through line 10 at a pressure of 5 MPa and at a temperature of 40° C. The composition of this gas in molar fractions is as follows:

| | |
|---|---|
| Methane: | 94.00% |
| Ethane: | 3.28% |
| Propane: | 1.23% |
| Isobutane: | 0.25% |
| n-butane: | 0.16%. |

The natural gas is mixed with the gas fraction recycled through line 109. The gas mixture thus obtained is sent through line 11 to exchanger E1, which it leaves through line 100 at a temperature of −47° C.

Heat exchanger E1 uses a first cooling mixture whose composition in molar fractions is as follows:

| | |
|---|---|
| Ethane: | 50.00% |
| Propane: | 50.00%. |

The first cooling mixture is compressed in the gas phase in multistage compressor K1 to a pressure of 3.19 MPa. It is condensed and cooled to a temperature of 40° C. in condenser C1.

The first cooling mixture is then sent to exchanger E1 and subcooled. A first fraction of the first cooling mixture is expanded through expansion valve V11 to a first pressure level of 1.28 MPa and vaporized. A second fraction of the first cooling mixture is then expanded through expansion valve V12 to a second pressure level of 0.59 MPa and vaporized. A third fraction of the first cooling mixture is expanded through expansion valve V13 to a third pressure level of 0.30 MPa and vaporized, which allows the desired temperature of −47° C. to be reached at the outlet of exchanger E1.

The natural gas leaving exchanger E1 is sent to exchanger E2, which it leaves at a temperature of −130° C. through line 101.

Heat exchanger E2 uses a cooling mixture M2 whose composition in molar fractions is as follows:

| | |
|---|---|
| Methane: | 37.00% |
| Ethane: | 59.00% |
| Propane: | 3.00% |
| Nitrogen: | 1.00%. |

The second cooling mixture is compressed in the gas phase in multistage compressor K2 to a pressure of 3.9 MPa. It is cooled to a temperature of 40° C. in exchanger C2, then it is sent to exchanger E1 which it leaves totally condensed at a temperature of 47° C. It is then sent to exchanger E2 which it leaves subcooled at a temperature of −130° C. At the outlet of exchanger E2, the second cooling mixture is expanded in expansion turbine T3 to a pressure of 0.37 MPa and vaporized in exchanger E2, which allows the temperature of −130° C. to be obtained at the outlet of exchanger E2.

The natural gas flowing from exchanger E2 at a temperature of −130° C. is expanded in turbine T21 to a pressure of 0.45 MPa. The two phases thus obtained are separated in drum B21. The temperature in drum B21 is −139° C. and the vaporized molar fraction represents 6% of the flow at the outlet of expansion turbine T21. The liquid fraction circulating in line 103 passes into exchanger E3, then it is expanded in expansion turbine T22 to a pressure of 0.12 MPa. The two phases thus obtained are separated in drum B22, the temperature in drum B22 being −158.6° C., and the vaporized molar fraction represents 13% of the flow at the outlet of expansion turbine T22. The vapor fraction circulating in line 105 then passes into exchanger E3 which it leaves at a temperature of −144° C. It is then sent to the inlet of compressor K3. The vapor fraction coming from separation drum B21, which is discharged through line 102, passes into exchanger E2 which it leaves at a temperature of −51.4° C. It is then sent through line 107 to an intermediate stage of recycle compressor K3. The gas mixture flowing from compressor K3 is cooled to a temperature of 40° C. by indirect heat exchanger C3.

For a production of 689,400 kg/h LNG, the mechanical powers supplied by compressors K1, K2 and K3 are respectively 86,110 kW, 86,107 kW and 20,900 kW.

The method described in connection with FIG. 2 is illustrated by the numerical example as follows.

The composition of the natural gas in molar fractions is as follows:

| | |
|---|---|
| Methane: | 90.00% |
| Ethane: | 4.00% |
| Propane: | 1.50% |
| Isobutane: | 0.30% |
| n-butane: | 0.20% |
| Nitrogen: | 4.00%. |

The natural gas is cooled to a temperature of −48.7° C. in exchanger E1. Heat exchanger E1 uses a first cooling mixture whose composition in molar fractions is as follows:

| | |
|---|---|
| Ethane: | 50.00% |
| Propane: | 50.00%. |

The natural gas flowing from exchanger E1 through line 100 is then cooled to a temperature of −132° C. in exchanger E2.

Exchanger E2 uses a second cooling mixture M2 whose composition in molar fractions is as follows:

| | |
|---|---|
| Methane: | 38.00% |
| Ethane: | 57.00% |
| Propane: | 4.00% |
| Nitrogen: | 1.00%. |

At the outlet of exchanger E2, the natural gas leaving in the liquid phase is expanded in turbine T21 to a pressure of 0.4 MPa. It is then sent to denitrogenation column CL1.

The gaseous fraction flowing from the top of denitrogenation column CL1 contains 33.82% nitrogen in molar fraction. This gaseous fraction is discharged and can be used notably as fuel gas in the plant.

The liquid fraction flowing from denitrogenation column CL1 contains no more than 1.1% nitrogen. It is expanded in turbine T22 to a pressure of 0.120 MPa. The two-phase mixture obtained is at a temperature of −159.5° C.

The vapor fraction from drum B22 represents in molar fraction 10.93% of the mixture obtained at the outlet of turbine T22 and it contains 7.7% nitrogen. It passes into exchanger E3 which it leaves at a temperature of −145° C. It is then recompressed in multistage compressor K3 and recycled.

The liquid fraction from drum B22 represents the LNG produced. Its composition in molar fractions (%) is as follows

| | |
|---|---|
| Methane: | 92.95% |
| Ethane: | 4.50% |
| Propane: | 1.69% |
| Isobutane: | 0.34% |
| n-butane: | 0.22% |
| Nitrogen: | 0.30%. |

In this example, the method according to the invention thus allows to produce denitrogenated LNG at a temperature of −159.5° C. and at a pressure close to the atmospheric pressure.

Heat exchangers E1 and E2 can be formed by combining various equipments.

The method according to the invention is preferably implemented with heat exchangers allowing multiple-pass and pure countercurrent heat exchanges. It is possible to use spiral-tube heat exchangers and/or brazed aluminium plate exchangers.

Plate exchangers are used by associating exchange modules in cold boxes.

What is claimed is:

1. A natural gas liquefaction method, comprising the following stages:

a) combining the natural gas with a compressed gas obtained in stage f) to obtain a mixture of natural gas, b) cooling the natural gas mixture and a second cooling mixture by indirect heat exchange with at least a first cooling mixture so as to obtain a cooled natural gas and a cooled second cooling mixture, then condensing and cooling the cooled natural gas by-indirect heat exchange with the cooled second cooling mixture and with a first gas fraction obtained in stage c) so as to obtain a liquefied natural gas under pressure, c) expanding the liquefied natural gas under pressure obtained in stage b) to obtain a liquid fraction and the first gas fraction, d) cooling the liquid fraction obtained in stage c) by indirect heat exchange with a second gas fraction obtained in stage e) so as to obtain a cooled liquid fraction and a heated second gas fraction, e) expanding the cooled liquid fraction obtained in stage d) to obtain a liquefied natural gas and the second gas fraction, f) compressing at least part of the heated second gas fraction obtained in stage d) to obtain the compressed gas.

2. A method as claimed in claim 1, wherein the liquefied natural gas under pressure obtained in stage b) is at a temperature higher by at least 10° C. than the bubble-point temperature of the liquefied natural gas obtained in stage e) at atmospheric pressure.

3. A method as claimed in claim 1, wherein the liquefied natural gas under pressure obtained in stage b) is at a temperature ranging between −105° C. and −145° C., and at a pressure ranging between 4 MPa and 7 MPa.

4. A method as claimed claim 1 wherein, in stage f), part of the first gas fraction obtained in stage c) and part of the heated second gas fraction obtained in stage d) are compressed to obtain a compressed gas.

5. A method as claimed in claim 1, wherein the liquid fraction and the first gas fraction obtained in stage c) are subjected to a denitrogenation treatment so as to enrich the first gas fraction with nitrogen.

6. A method as claimed in claim 1 wherein, in stage d), the liquid fraction obtained in stage c) is cooled by heat exchange with the second gas fraction obtained in stage e) and with part of the cooled second cooling mixture.

7. A method as claimed in claim 1 wherein, in stage a), the natural gas is at a temperature ranging between 30° C. and 60° C., and at a pressure ranging between 4 MPa and 7 MPa.

8. A method as claimed in claim 1 wherein, in stage b), the natural gas mixture and the second cooling mixture are cooled to a temperature ranging between −35° C. and −70° C. by heat exchange with the first cooling mixture.

9. A method as claimed in claim 1 wherein, in stage c), said liquefied natural gas under pressure is expanded to a pressure ranging between 0.2 MPa and 1 MPa, and wherein, in stage e), said liquid fraction is expanded to a pressure ranging between 0.05 MPa and 0.5 MPa.

10. A method as claimed in claim 1, wherein the first cooling mixture comprises in molar fraction the following components:

| | |
|---|---|
| Ethane: | 30% to 70% |
| Propane: | 30% to 70% |
| Butane: | 0% to 20%. |

11. A method as claimed in claim 1, wherein the second cooling mixture comprises in molar fraction the following components:

| | |
|---|---|
| Nitrogen: | 0% to 10% |
| Methane: | 30% to 70% |
| Ethane: | 30% to 70% |
| Propane: | 0% to 10%. |

* * * * *